United States Patent [19]

Tse

[11] 4,324,400

[45] Apr. 13, 1982

[54] TABLE TENNIS BAT BLADE

[75] Inventor: Jackson Tse, Bellevue, Wash.

[73] Assignee: EST Industries, Inc., Wash.

[21] Appl. No.: 64,555

[22] Filed: Aug. 8, 1979

[51] Int. Cl.[3] ..... A63B 59/04

[52] U.S. Cl. ..... 273/76; 273/DIG. 7; 273/DIG. 23

[58] Field of Search ..... 273/73 F, 76, DIG. 7, 273/23, 67 R, 67 A, 67 D

[56] References Cited

U.S. PATENT DOCUMENTS

| | | | |
|---|---|---|---|
| 3,201,138 | 8/1965 | Brown | 273/73 F X |
| 3,635,483 | 1/1972 | Barriball et al. | 273/73 F X |
| 3,691,000 | 9/1972 | Kalnin | 273/73 F X |
| 3,758,126 | 9/1973 | Zemlin et al. | 273/73 F X |
| 3,787,051 | 1/1974 | Johns | 273/73 F |
| 3,816,573 | 6/1974 | Hashimoto et al. | 273/73 F X |
| 3,902,732 | 9/1975 | Fosha et al. | 273/73 F X |
| 3,997,161 | 12/1976 | Lemke | 273/76 |
| 4,023,799 | 5/1977 | Van Auken | 273/73 F |
| 4,070,020 | 1/1978 | Dano | 273/73 F |

FOREIGN PATENT DOCUMENTS

| | | | |
|---|---|---|---|
| 2414284 | 10/1976 | Fed. Rep. of Germany | 273/76 |
| 2632820 | 2/1977 | Fed. Rep. of Germany | 273/76 |
| 998816 | 9/1951 | France | 273/76 |
| 776065 | 6/1957 | United Kingdom | 273/67 D |
| 1436436 | 5/1976 | United Kingdom | 273/76 |

OTHER PUBLICATIONS

"Research Disclosure"; Disclosure No. 11686, Dec. 1973.

*Primary Examiner*—Richard J. Apley
*Attorney, Agent, or Firm*—Graybeal & Uhlir

[57] ABSTRACT

The blade for a table tennis bat includes a layer of lightweight, low modulus of elasticity material positioned centrally with respect to the thickness of the blade and overlaid by a constraining layer of high modulus of elasticity material. The blade also includes a smooth, rigid outer layer bonded to the outer surfaces of the two constraining layers. The constraining layers are composed of strands of stretch resistant material woven transversely to each other to form a thin mat.

5 Claims, 2 Drawing Figures

TABLE TENNIS BAT BLADE

BACKGROUND OF THE INVENTION

1. Field of the Invention

The present invention relates to table tennis bats, and more particularly to a new, lightweight, stiff bat blade.

2. Description of the Prior Art

The development of table tennis racquets, also called bats, has been devoted almost exclusively to the striking surfaces rather than to the underlying blade. In the earliest table tennis bats, the hitting surfaces were simply made from wood. Since that time, bats have usually been covered with a sheet of hard rubber having outwardly directed pimples. This construction enabled the players to "feel" the ball and also permitted them to impart greater spin on the ball.

Subsequently a layer of cellular sponge was interposed between the wood bat and the sheet of pimpled rubber. The rubber of sponge functions somewhat like the strings of a tennis racquet to impart an elastic rebounding force to the ball thereby increasing the speed at which the ball left the bat. Later the outer sheet of rubber was turned face down with the pimples directed into the layer of sponge. Although this change in the direction of the pimples changed the speed at which the ball rebounded from the bat, the corresponding increase in ball contacting area enabled the player to impart even more spin on the ball.

The evolution of bat blades, on the other hand, has lagged behind the advancements made in the design of the striking surfaces. The first bat blades were made from a single piece of wood. Subsequently, bats have been constructed from multiple layers of wood glued and pressed together to form a plywood structure. Although plywood bats are generally stiffer than single piece bats thereby enabling the player to hit the ball with more force, the corresponding increase in shock and vibration transmitted from the ball to the bat makes it more difficult for the player to control both the direction the ball travels and the amount of spin imparted to the ball.

SUMMARY OF THE INVENTION

The present invention relates to a new table tennis bat blade which, in basic form, is composed of a layer of rigid, lightweight, low modulus of elasticity material positioned centrally with respect to the thickness of the blade. A thin, intermediate constraining layer of high modulus of elasticity material is bonded to each surface of the core layer. Additionally, the blade includes a smooth, rigid outer layer bonded to the outer surfaces of said two constraining layers. The constraining layers may be composed of a thin sheet of material or of fibers formed into strands with the strands then woven transversely to each other to form a mat.

In a table tennis bat blade constructed according to the present invention, the central core layer of low modulus of elasticity material stabilizes the bat by absorbing vibrations imparted to the bat by the ball thereby improving the player's ability to direct his shots and impart precisely the desired amount and type of spin to the ball. This is especially important since most widely used playing techniques involve applying a large amount of top spin to the ball. Furthermore, applicant has found that the two constraining layers enhance the rigidity of the blade without adding significant weight.

As a result, more of the energy of the swinging bat is imparted to the ball.

It is a primary object of the present invention to provide a table tennis bat blade which is not only stiff, but also light in weight so that it can be quickly maneuvered by the player.

Another object of the present invention is to provide a stable table tennis bat blade which is capable of absorbing the shock loads imparted on the bat by the ball.

A further object of the present invention is to provide a table tennis bat blade which is constructed of sufficient structural integrity to withstand rugged use.

One more object of the present invention is to provide a table tennis bat blade constructed from a composite of different materials to optimize the desirable characteristics of the blade.

Yet another object of the present invention is to provide a table tennis bat blade constructed from a shock absorbing, lightweight central core sandwiched between layers of lightweight, high modulus of elasticity material.

Other objects and advantages of the present invention will be apparent from the following description taken with the accompanying drawings.

DETAILED DESCRIPTION

Figure 1:
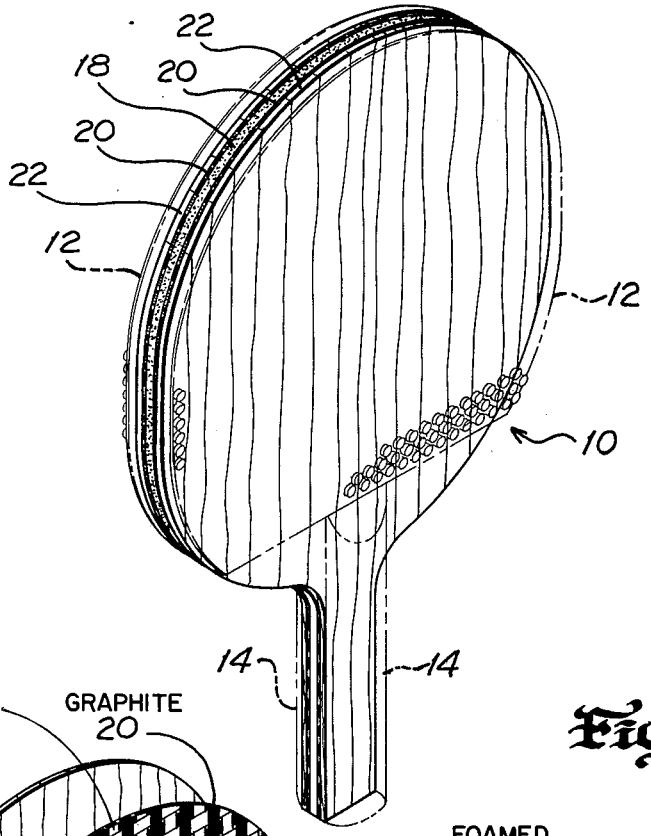
FIG. 1 is a perspective view of one typical embodiment of the present invention to which has been added hitting surfaces and a handle shown in phantom.

Referring to FIG. 1, a table tennis bat incorporating a typical blade 10 constructed according to the present invention, and which is also the best mode of the invention currently known to applicant, is shown. A conventional hitting surface 12 and handle 14, both shown in phantom lines, have been added to each side of blade 10. As is common in current bat design, hitting surface 12 can be constructed from pimpled rubber with the pimples directed either toward or away from an underlying sponge layer, not shown. The rubber used to form hitting surface 12 is preferably tacky to allow the player to impart a spin to the ball when the ball is struck. The underlying sponge layer is initially compressed when the bat first strikes the ball and resumes its normal shape to resiliently propel the ball away from the bat in a manner somewhat similar to the function of the strings of a tennis racket.

Figure 2:
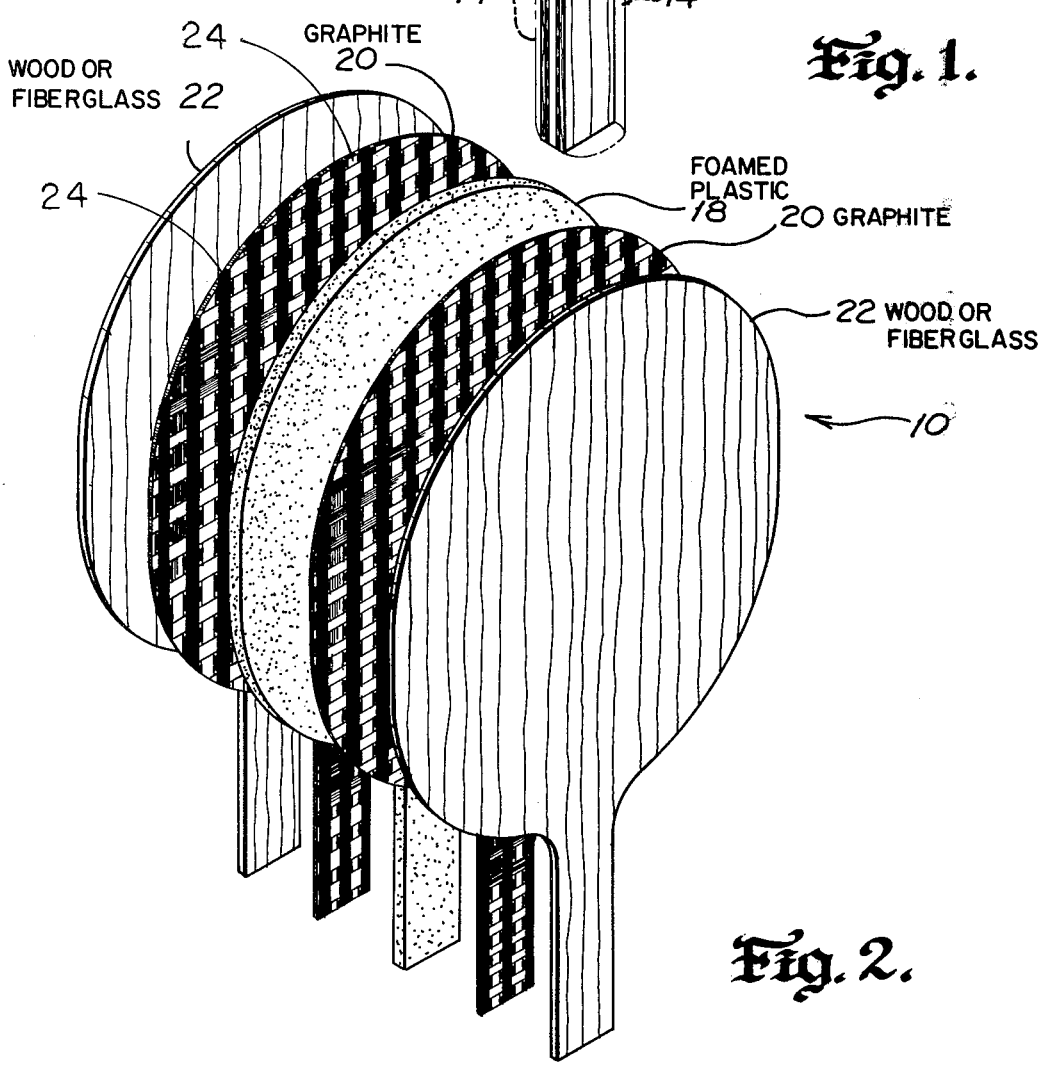
FIG. 2 is an exploded perspective view of the typical embodiment of the present invention shown in FIG. 1.

Now referring also to FIG. 2, blade 10 is shown to include a core layer 18 located centrally with respect to the thickness of blade 10. A constraining layer 20 of thin, stretch resistant material is bonded to core layer 18 with a suitable adhesive applied with heat and under pressure. Blade 10 further includes outer layers 22 overlying and bonded to each of the two constraining layers 20.

Central core layer 18 is constructed from a lightweight, cellular but rigid, low modulus of elasticity material. Ideally central core 18 is formed from rigid, open cell polyurethene foam having a density of approximately ten pounds per cubit foot, a modulus of elasticity of approximately 12,000 to 16,000 pounds per square inch and a thickness of approximately one-eighth of an inch. Applicant has found that constructing core layer 18 from foamed plastic material results in a stable bat which is capable of absorbing the shock loads and damping the vibrations generated by the striking of the ball. Although the above mentioned density and thickness of foamed plastic core 18 is preferred, the extent to which shock loads are absorbed can be selectively increased or decreased by altering these parameters.

Rather than utilizing foamed plastic, core layer 18 can be constructed from other materials such as honeycomb plastic, honeycomb fiberglass or even nylon sheet. However, these materials do not absorb shock loads and dampen vibrations as effectively as the preferred foamed plastic material.

Applicant has discovered that adding a layer of foamed plastic to the center of the conventional wooden blade, while stabilizing the bat, also weakens it to the extent that excessive deflection of the bat occurs when the ball is struck. Accordingly, since a portion of the energy of the moving ball and bat is expended to bend the bat, less of the total momentum of the bat and the ball is available to propel the ball so that the rebounding ball travels at a slower speed than if it were hit with a more rigid bat. Furthermore, simply adding core layer 18 to a conventional wood blade also reduces the structural integrity and thus the durability of the bat.

The two constraining layers 20, spaced apart by core 18, are preferably composed of lightweight, high modulus of elasticity material which effectively minimizes the deflection or bending of blade 10 when a ball is struck. As shown best in FIG. 2, constraining layers 20 are constructed from strands 24 of stretch resistant fibers woven transversely relative to each other to form a mat. Strands 24 are aligned parallel and perpendicularly to the length of blade 10. Ideally, strands 24 are composed of graphite fibers which not only exhibit a high modulus of elasticity of typicaly 30 to 100 million pounds per square inch, but also are very light in weight. Applicant has found that the strands of graphite can be alternated with strands of other materials exhibiting similar properties, such as Kevlar having a modulus of elasticity of approximately 19 million pounds per square inch or fiberglass having a modulus of elasticity of approximately 10 to 12.5 million pounds per square inch, thereby appreciably reducing the cost of constructing blade 10 without significantly diminishing the strength of constraining layer 20. Also, constraining layers 20 can be composed of woven strands of Kevlar alternated with fiberglass.

Rather than utilizing a woven design, constraining layers 20 alternatively may be formed from strips of graphite arranged multidirectionally, bidirectionally or unidirectionally or even from graphite that has been pressed into a thin sheet. Constructing constraining layers 20 in thin sheets will enable said sheets to resist deflection of a table tennis bat in all directions along the plane of blade 10.

Outer layers 22 are illustrated in FIGS. 1 and 2 as composed of thin, flat sheets which have been bonded to constraining layer 20 with a conventional adhesive applied under heat and pressure. Ideally the material used to form outer layers 22 should be lightweight, durable and also exhibit a fairly high modulus of elasticity. Applicant has utilized spurce, typically exhibiting a modulus of elasticity of approximately one million to two million pounds per square inch, to form outer layers 22 but other high tensile strength woods, such as bass wood or birch, may also be employed successfully. Furthermore, non-wooden materials, which also exhibit these characteristics, for example fiberglass, may be employed.

The adhesive utilized to bond constraining layers 20 to core layer 18 and outer layers 22 to constraining layers 20 is an epoxy type laminating resin, liquid in form, and activated by heat and pressure. Resins for bonding together the types of materials that these bat blade components are constructed from are well known and widely available.

High speed photographic techniques have disclosed that conventional table tennis bats flex or deform when swung rapidly by a player striking a ball. As a result, the fibers or elements on the concave side of the neutral axis of the flexed blade are compressed by flexural compressive stresses while the fibers or elements on the convex side of the neutral axis are longitudinally stretched or extended by flexural tensile stresses. Furthermore, the compressive stresses vary along the thickness of the blade from a maximum at the outer concave surface of the blade to a theoretical minimum at the neutral axis of the blade. Correspondingly, the tensile stresses and the fibers of the opposite side of the blade vary from a maximum at the convex outer surface of the blade to a minimum of zero at the neutral axis of the blade.

Thus, in accord with the present invention if a structure, such as blade 10, were constructed from high modulus of elasticity material, such as constraining layers 20, spaced outwardly from the neutral axis of the blade by central core 18 so that such layers would be subjected to significant tensile and compressive flexural stresses, a smaller deflection of the blade would occur for a given impact load in relation to a blade constructed from low modulus of elasticity material. Applicant has found that bonding strands 24 of graphite fibers to each surface of centrally located core layer 18, in fact results in a blade 10 which is deflected only a small amount by the impact between the bat and the ball. Furthermore, by arranging the strands 24 of graphite fibers in a cross-weave pattern, blade 10 is strengthened in both its longitudinal and transverse directions thereby providing a more continuous, unitary structure than if strands 24 were aligned only in one direction. As a result of this particular construction, the entire surface of the bat can be utilized as an active hitting zone or "sweet-spot". Thus, unlike a conventional bat, a player does not have to make solid contact with the ball only in the center of the bat. An "off-center" hit can be made while still imparting the same power and speed to the ball.

Applicant has found that while constructing a table tennis bat blade to include a high modulus of elasticity constraining layer or layers improves the stiffness, rigidity and durability of the blade, a more vibration prone bat than a bat constructed without such constraining layers is produced. Consequently, a player can less accurately direct his shots or control the type and amount of spin which he desires to impart on the ball.

Applicant has also discovered that constructing a blade having a central layer of shock absorbent, low modulus of elasticity material stabilizes the bat by damping the vibrations and absorbing the shock loads which occur when a ball is hit. However, this type of construction also reduces the stiffness and durability of the bat. Applicant's new and unobvious use of high modulus of elasticity constraining layers 20 to sandwich a low modulus of elasticity core layer 18 has unexpectedly resulted in a lighter and thinner bat blade exhibiting improved stiffness, stability and durability. A thinner table tennis bat is subjected to less air resistance, and thus can be maneuvered more freely and quickly than a thicker bat. A lighter bat is subjected to less inertial resistance to thereby enable a player to react faster and with great bat maneuverability than with a heavier bat. Thus, what would seem to be the worst blade combination, namely a structurally weak, low modulus of elasticity, core layer and a highly vibration prone constraining layer results in a table tennis blade having surprisingly superior performance characteristics.

Applicant's invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced herein.

What is claimed is:

1. In a table tennis bat having a solid blade portion constituting the striking surfaces and a handle, an improved blade comprising:

a thin outer layer of smooth, rigid, lightweight material underlying each striking surface, said outer layers having a modulus of elasticity of at least one million pounds per square inch;

an intermediate, substantially homogeneous constraining layer of high modulus of elasticity graphite fibers arranged in a relatively thin layer and bonded to the underside of each of said outer layers, said constraining layers having a modulus of elasticity of approximately thirty to one hundred million pounds per square inch;

a central core layer of lightweight, rigid, foamed plastic material disposed between said two constraining layers, said central core layer having a modulus of elasticity of approximately twelve thousand to sixteen thousand pounds per square inch; and wherein said outer layer is composed of spruce wood material.

2. In a table tennis bat having a solid blade portion constituting the striking surfaces and a handle, an improved blade comprising:

a thin outer layer of smooth, rigid, lightweight material underlying each striking surface, said outer layers having a modulus of elasticity of at least one million pounds per square inch;

an intermediate, substantially homogeneous constraining layer of high modulus of elasticity graphite fibers arranged in a relatively thin layer and bonded to the underside of each of said outer layers, said constraining layers having a modulus of elasticity of approximately thirty to one hundred million pounds per square inch;

a central core layer of lightweight, rigid, foamed plastic material disposed between said two constraining layers, said central core layer having a modulus of elasticity of approximately twelve thousand to sixteen thousand pounds per square inch; and wherein said outer layer is composed of fiberglass material.

3. In a table tennis bat blade having a solid blade portion constituting the striking surfaces and a handle, such solid blade portion including a central core layer of lightweight, rigid, foamed plastic material, an improved blade portion comprising:

an intermediate, substantially homogeneous constraining layer of high modulus of elasticity graphite fibers arranged in a relatively thin layer and bonded to the two outer surfaces of the central core layer, said constraining layers having a modulus of elasticity of approximately 30 to 100 million pounds per square inch;

a thin outer layer of smooth, rigid, lightweight material overlying both constraining layers, said outer layers having a minimum modulus of elasticity of at least one million pounds per square inch and a maximum modulus of elasticity substantially lower than the modulus of elasticity of said constraining layers; and said central core layer having a modulus of elasticity of approximately 12,000 to 16,000 pounds per square inch.

4. The improvement according to claim 3, wherein each of said two constraining layers is formed from strands of graphite fibers woven together to form a thin mat, said strands of graphite fibers being disposed transversely to each other to form a cross-weave pattern.

5. The improvement according to claim 3, wherein said two constraining layers further comprise strands of lightweight secondary fiberglass fibers having a modulus of elasticity in the range of ten to nineteen million pounds per square inch interwoven with said strands of graphite fibers.

* * * * *

UNITED STATES PATENT AND TRADEMARK OFFICE

CERTIFICATE OF CORRECTION

PATENT NO. : 4,324,400

DATED : April 13, 1982

INVENTOR(S) : Jackson Tse

It is certified that error appears in the above—identified patent and that said Letters Patent is hereby corrected as shown below:

Column 1, line 20, "rubber" should read -- layer --.

Signed and Sealed this

Sixth Day of July 1982

[SEAL]

*Attest:*

GERALD J. MOSSINGHOFF

*Attesting Officer*

*Commissioner of Patents and Trademarks*